US007004130B2

(12) United States Patent
Bolz et al.

(10) Patent No.: US 7,004,130 B2
(45) Date of Patent: Feb. 28, 2006

(54) CAMSHAFT ADJUSTER FOR AN INTERNAL COMBUSTION ENGINE HAVING HYDRAULIC MEDIUM GUIDES

(75) Inventors: Gerald Bolz, Berlin (DE); Christian Haser, Berlin (DE); Kai Lehmann, Ludwigsfelde (DE); Timo Schmidt, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/960,247

(22) Filed: Oct. 7, 2004

(65) Prior Publication Data

US 2005/0109298 A1 May 26, 2005

(30) Foreign Application Priority Data

Oct. 7, 2003 (DE) ..... 103 46 446

(51) Int. Cl.
*F01L 1/34* (2006.01)

(52) U.S. Cl. ..... 123/90.17; 123/90.31; 123/90.15

(58) Field of Classification Search ..... 123/90.17, 123/90.31, 90.15
See application file for complete search history.

(56) References Cited

U.S. PATENT DOCUMENTS

| | | | | |
|---|---|---|---|---|
| 3,841,284 | A * | 10/1974 | Krygowski | 123/545 |
| 4,805,571 | A * | 2/1989 | Humphrey | 123/316 |
| 5,031,583 | A | 7/1991 | Konno | |
| 5,273,007 | A | 12/1993 | Ampferer | |
| 5,540,197 | A | 7/1996 | Golovatai-Schmidt et al. | |
| 5,829,399 | A | 11/1998 | Scheidt et al. | |
| 6,053,139 | A | 4/2000 | Eguchi et al. | |
| 6,142,257 | A * | 11/2000 | Bruener et al. | 184/12 |
| 6,450,139 | B1 | 9/2002 | Watanabe | |
| 2001/0013324 | A1 * | 8/2001 | Yoshizawa et al. | 123/90.16 |
| 2003/0070639 | A1 * | 4/2003 | Kohrs | 123/90.17 |

FOREIGN PATENT DOCUMENTS

| | | |
|---|---|---|
| DE | 363 862 | 11/1922 |
| DE | 196 45 688 | 5/1988 |
| DE | 40 07 181 | 9/1991 |
| DE | 40 24 056 | 9/1991 |
| DE | 40 19 766 | 1/1992 |
| DE | 195 02 496 | 8/1996 |

(Continued)

*Primary Examiner*—Thomas Denion
*Assistant Examiner*—Zelalem Eshete
(74) *Attorney, Agent, or Firm*—Collard & Roe, P.C.

(57) ABSTRACT

A camshaft adjuster for an internal combustion engine having hydraulic medium guides. The adjuster can include a setting unit that can be controlled by a control unit using these guides in the adjuster, wherein the setting unit is for adjusting an angle of a camshaft. This setting unit has an inner body coupled to the camshaft so as to rotate with it, and an outer body that is mounted to rotate relative to the camshaft via a drive connection which runs from a crankshaft to the camshaft. The camshaft has at least one insert part permanently inserted camshaft wherein these two components together form at least one hydraulic medium guide at least in partial regions over its axial length. This design is to create a camshaft adjuster which is in interaction with a camshaft having an insert part so that there is a simple and reliable supply of hydraulic medium to the camshaft adjuster and in particular to its control device.

30 Claims, 10 Drawing Sheets

FOREIGN PATENT DOCUMENTS

| | | |
|---|---|---|
| DE | 196 15 076 | 6/1997 |
| DE | 199 18 910 | 11/1999 |
| DE | 198 27 860 | 12/1999 |
| DE | 101 25 498 | 12/2002 |
| DE | 101 35 146 | 1/2003 |
| DE | 101 38 832 | 1/2003 |
| DE | 101 43 862 | 3/2003 |
| WO | WO 01/49978 | 7/2001 |

* cited by examiner

CAMSHAFT ADJUSTER FOR AN INTERNAL COMBUSTION ENGINE HAVING HYDRAULIC MEDIUM GUIDES

CROSS REFERENCE TO RELATED APPLICATIONS

This application hereby claims priority from German Application Serial No. 103 46 446.8 filed on Oct. 7, 2003, wherein priority is claimed under 35 U.S.C. §119.

BACKGROUND OF THE INVENTION

The invention relates to a camshaft adjuster for an internal combustion engine having hydraulic medium guides.

To reduce fuel consumption and the emission of untreated gases, as well as to increase power and torque, diesel engines are generally fitted with camshaft adjusters. These adjusters change the phase position of the camshaft relative to the crankshaft. Currently, hydraulic vane cell adjusters having working chambers are used, in most instances. The adjustment is made via the controlled entry of oil into the chambers of the vane cells, from the engine circuit, via a control valve. The control valve is moved by means of an electromagnetic device.

A camshaft adjuster of this type, for an internal combustion engine having hydraulic medium channels, is known from DE 40 19 766 C2 which relates to a corresponding U.S. Pat. No. 5,273,007 the disclosure of which is hereby incorporated herein by reference. The camshaft adjuster, which is fitted with an axial adjustment piston, can be controlled with hydraulic medium channels, to adjust the angle of a camshaft. This reference describes a connection of the hydraulic medium channels from the camshaft bearing to a related adjustment chamber, in each instance. However, with this disclosure, the control of the camshaft adjuster is not described. The channel design of the hydraulic medium channels includes at least two channels. This design includes coaxially arranged channels that make a transition into a ring gap, in each instance, and form a variant that causes restrictions via production technology. The ribbed insert shown has the disadvantage that the stream of oil must flow around many edges, which are disadvantageous in terms of flow technology, and this results in disadvantageous oil foaming, particularly due to the rotating camshaft. In addition, the proposed embodiment shown as a plastic part does not ensure any permanent, fixed seat in the camshaft, because of creep at the engine operating temperature. Furthermore, the ribs shown, in combination with the ring grooves, cause a complicated die embodiment in an injection-molding die.

A camshaft adjuster for an internal combustion engine having hydraulic medium guides is also known from DE 199 18 910 A1 with a corresponding U.S. Pat. No. 6,053,139 the disclosure of which is hereby incorporated herein by reference. Using the hydraulic medium guides, it is possible to control a setting unit by way of a control valve, to adjust the angle of a camshaft. In this case, the setting unit has an inner body connected with the camshaft so as to rotate with it, and an outer body mounted to rotate relative to the camshaft, by way of which a drive connection runs from the crankshaft to the camshaft. The hydraulic setting unit has hydraulic medium applied to it, in targeted manner, by way of the control valve that is fixed in place relative to the camshaft. The control valve has a control piston that is guided in a central straining screw, so as to be displaced in the axial direction relative to the central straining screw. The inner body is braced axially against the camshaft by way of the central straining screw. The hydraulic medium guides are formed in the camshaft, whereby a hydraulic medium guide is arranged around the central straining screw. Accordingly, there is a relatively high level of machining effort for channels in the camshaft that carry hydraulic medium, i.e. in components adjacent to the camshaft.

An improved embodiment of the design of the hydraulic medium channels is known from DE 363862 A1, in the form of a tube that is pushed into the camshaft. However, this has the disadvantage of a very limited channel design, which can only be used with certain restrictions for supplying hydraulic medium to a camshaft adjuster.

In reference WO 0149978 A1, there is disclosed a simplified configuration of hydraulic medium channels which is represented via an insert piece having grooves that run in an axial direction, in interaction with the inside wall of the camshaft. This design has the disadvantage that the insert part must have a high level of dimensional accuracy, if independent channels are formed in adjacent grooves, in order to provide a secure seal. This is particularly difficult to accomplish with the specific embodiment disclosed, which has a formed sheet-metal part. Furthermore, the aforementioned positioning of the hydraulic adjustment unit on the camshaft turn represents a clear restriction.

With regard to the general technical background, reference is also made to German Patents DE 195 02 496 A1 and DE 196 1.5 076 C2 which have respective-corresponding U.S. applications in the form of U.S. Pat. Nos. 5,540,197 and 5,829,399 the disclosures of which are hereby incorporated herein by reference.

SUMMARY OF THE INVENTION

At least one embodiment of the invention is designed for structuring a camshaft adjuster in interaction with a camshaft having an insert part, so that there is a simple and reliable supply of hydraulic medium to the camshaft adjuster and, in particular, its control device. In addition, at least one embodiment is designed so that this design allows easy and cost-effective production of the camshaft adjuster and hydraulic medium guide.

A camshaft adjuster for an internal combustion engine can comprise a camshaft, a setting unit having an inner body coupled to the camshaft so as to rotate with it; and an outer body that is mounted in an outer region relative to the camshaft, and a control unit for adjusting an angle of the camshaft. There can be at least one insert part inserted in an inner region of the camshaft wherein the insert part and the camshaft form at least one hydraulic medium guide. These hydraulic medium guides are in communication with the control unit and the setting unit is in communication with the at least one hydraulic medium guide.

One significant advantage of the camshaft adjuster is that the hydraulic medium guides required for the hydraulic control of the camshaft adjuster are formed by the interaction of an insert part that is inserted into the camshaft, in direct or indirect connection with a hydraulic control valve of the camshaft adjuster. In this connection, the control valve can be positioned in any desired part of the engine housing or cylinder head or adjacent parts, or can be integrated into the actual camshaft adjuster itself. With this design, the hydraulic medium channels, by means of a suitable channel design, run, for example, from the pressure medium inflow either directly from a cavity within the camshaft or by way of a tapping location on a camshaft bearing.

This channel may extend through the insert part by way of a hydraulic medium guide channel, for example, into a housing part located close to, or on the hydraulic control valve, to a hydraulic control valve located outside the camshaft. This channel can extend from there back to the insert part and, by way of a different hydraulic medium channel in the insert part, to a chamber of the camshaft adjuster that adjusts the camshaft adjuster in the early or late position.

With this design, the transfer conduit of the hydraulic medium to be guided from the camshaft to the hydraulic medium guide channel located in the housing can be formed by providing grooves assigned to the individual channels in the housing and in the insert part, or by way of an appropriately configured transfer unit between the housing and the camshaft. This transfer unit can be arranged on the outer mantling of the camshaft. With this design, based on the way in which hydraulic medium guides are configured, by means of an insert part inserted into the camshaft, there is no machining required for the camshaft or components adjacent to the camshaft, with regard to making axially running hydraulic medium channels. Thus, the machining effort in this regard is completely eliminated. The formation of axial channels that are not structured to be coaxial results in the advantage of optimal positioning of the channels with regard to the hydraulic medium channel function, as well as the connection of the transfer interfaces with the control valve as well as with the camshaft adjuster at the camshaft.

Furthermore, for a simple representation of the insert part, for example, by means of plastic injection molding or light metal die-casting, the formation of non-coaxial channels that are aligned at least approximately in the camshaft axis, with radial connection channels, is advantageous, since the mold die requires only individual lateral slides or a simple divided mold die.

For reliable and permanently creep-resistant attachment of a plastic part pressed into the camshaft, there is an embodiment in which the structure that takes over the press fit preferably consists of metal and is integrated into the insert part using the plastic injection-molding process, for example. With this design, the support structure that carries the press fit can be represented by means of closed rings or by means of suitably configured segments or support elements that support one another.

A cross-section of the hydraulic medium guide channels in the insert part that changes at least in segments over the axial expanse of the insert part allows a formation of the hydraulic medium guide channels that is optimized for flow and/or adapted to the volume stream or to the production method.

Furthermore, greater tolerances are possible at the hydraulic medium transfer locations between the camshaft adjuster and the camshaft by means of the insert part. For example in the positioning of the camshaft adjuster relative to the camshaft, it is possible to primarily pay attention to the correct transfer of torque, and only secondarily to the transfer of hydraulic medium at the interface between the camshaft adjuster and the camshaft.

Furthermore, the operational reliability of the camshaft adjustment increases, since possible causes of failure are eliminated with the elimination of the screw connections. Furthermore, a cost reduction is also achieved in that the interfaces for joining become simpler.

Furthermore, the insert part, in addition to supplying hydraulic medium to the working chambers of a camshaft adjuster, also supplies a locking device of the camshaft adjuster and a camshaft bearing located farther towards the shaft end, for example, without any great additional effort.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
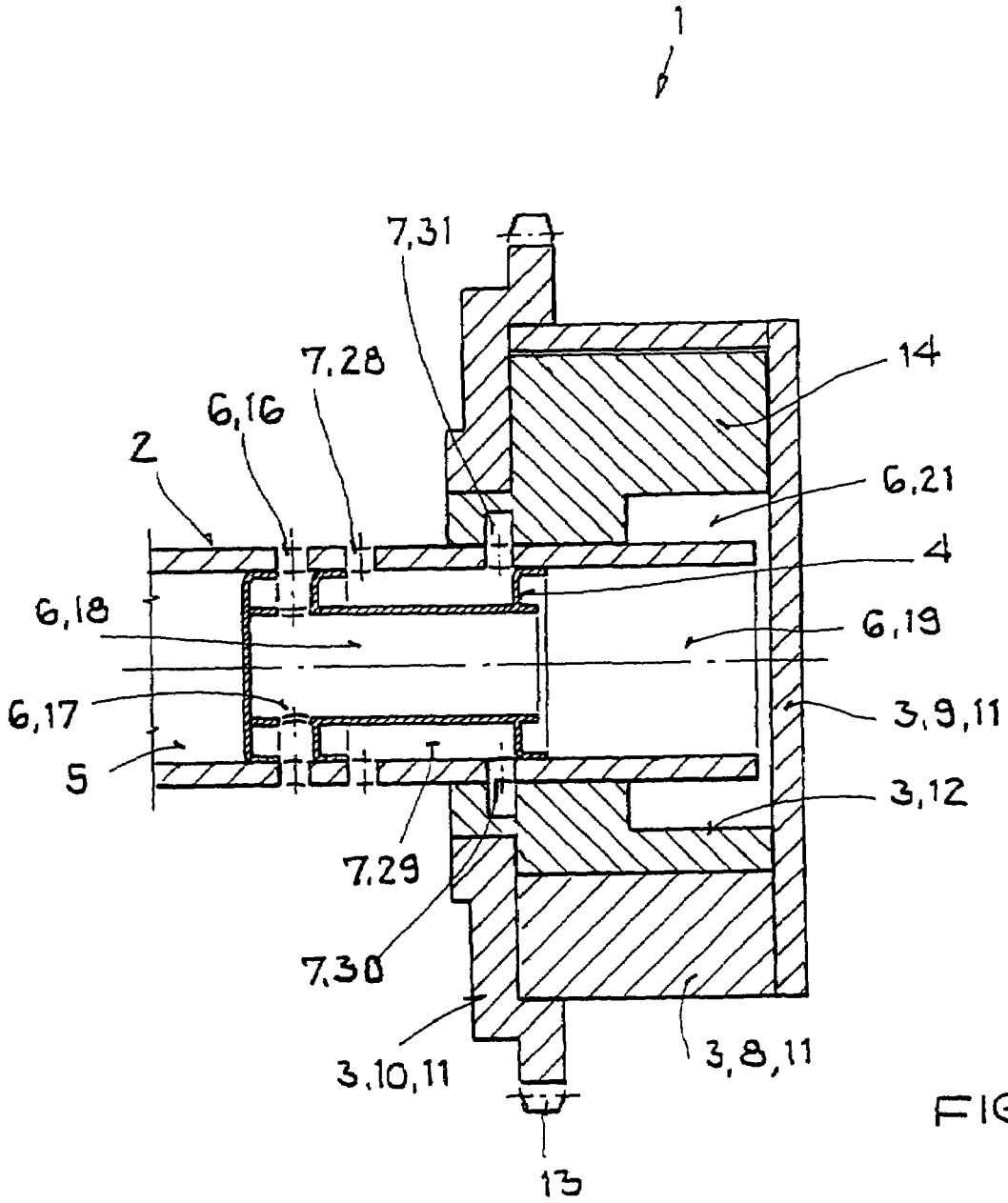
FIG. 1 is a longitudinal cross-section through a first embodiment of a camshaft adjuster.

Turning in detail to the drawings, the camshaft adjuster according to FIGS. 1 to 9 is designated, overall, as 1, and is represented as associated with a camshaft 2 of an internal combustion engine. Camshaft adjuster 1 has a control unit 38 shown in FIGS. 5 to 9, with which hydraulic medium can be applied, in a targeted manner, to a setting unit 3, to adjust the angle of camshaft 2. It is advantageous if control unit 38 comprises a hydraulic control unit or valve 38 that is arranged outside the camshaft 2 and is fixed in place relative to the camshaft 2.

At least one insert part 4 is inserted into an interior region of camshaft 2, which part, together with camshaft 2, forms hydraulic medium guides 5, 6, and 7 to supply camshaft adjuster 1. Hydraulic medium guides 5 to 7 are parts of hydraulic medium circuits, whereby a first hydraulic medium circuit 5 serves to supply a control valve 38, a second hydraulic medium circuit 6 serves to supply a working chamber A, (not visible), of the camshaft adjuster 1, and a third hydraulic medium circuit 7 serves to supply a working chamber B, (not visible), of camshaft adjuster 1.

To allow simple and reliable supply of hydraulic medium to the camshaft adjuster and, in particular, to its control unit, and also allow for simple and cost-effective production of the camshaft adjuster and the hydraulic medium guide, at least one hydraulic medium guide 5, 6, or 7 is connected, directly or by way of a transfer unit 74 (FIG. 6) and/or a channel 66, 67, 69, 83, 88, 94, 99, 100, 101 (FIGS. 5–9) located outside the camshaft 2, with control unit 38 of camshaft adjuster 1.

Figure 8:
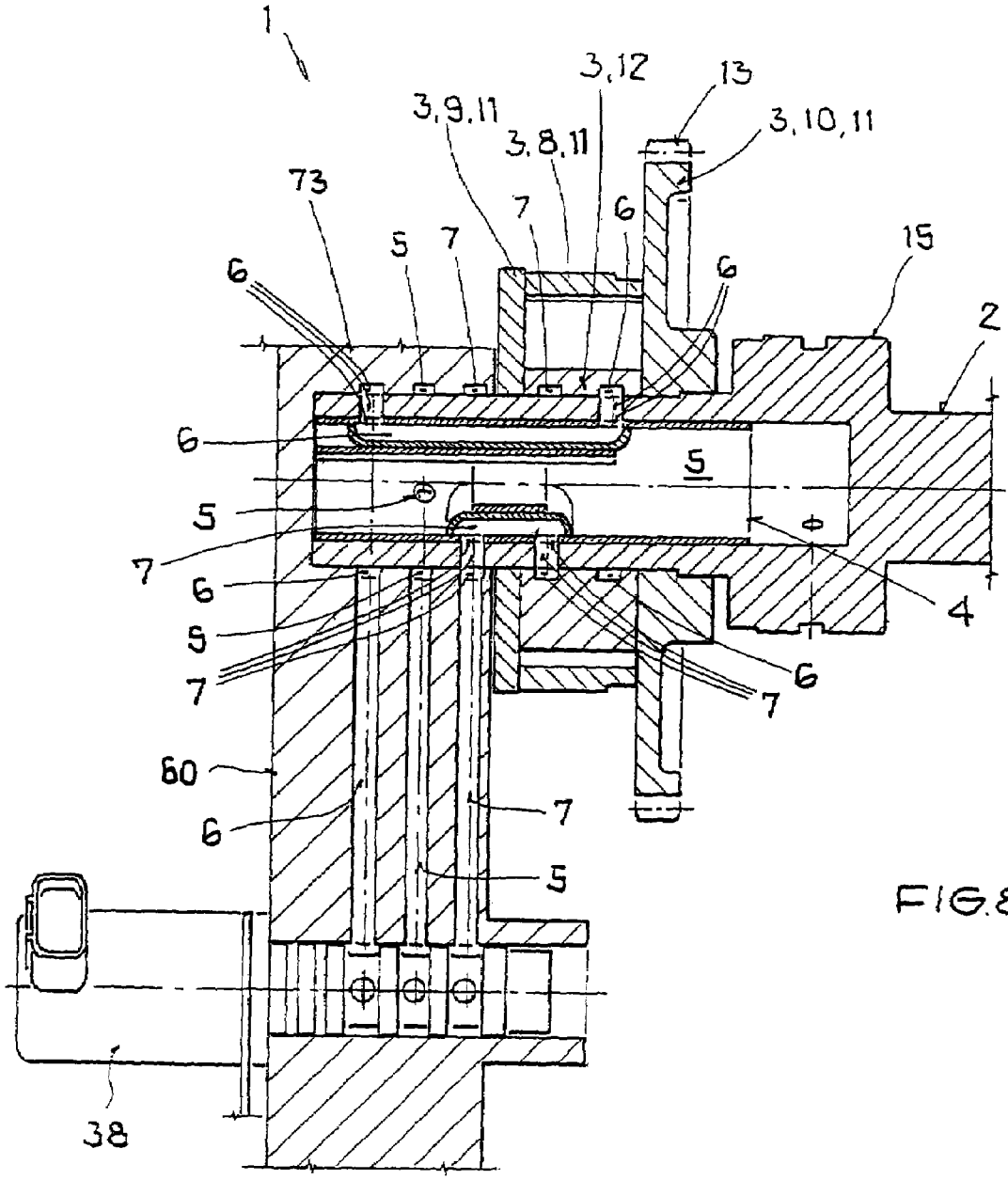
FIG. 8 is a longitudinal cross-section through an eighth embodiment of a camshaft adjuster wherein the insert part is configured in multiple parts.

Insert part 4 can be structured in one piece or, according to FIG. 8, in multiple pieces. Insert part 4 can be produced from sheet-metal formed parts and/or pipes. With a multi-part embodiment of the insert part 4, made of sheet-metal parts and/or pipes, the parts can be permanently connected with one another by welding, soldering, gluing, crimping, riveting, pressing, shrinking in place, or pass-through joining. Thermal joining, gluing, welding, internal high-pressure forming, etc. can be used as joining methods for the insertion of the insert part 4 into camshaft 2.

Figure 2:
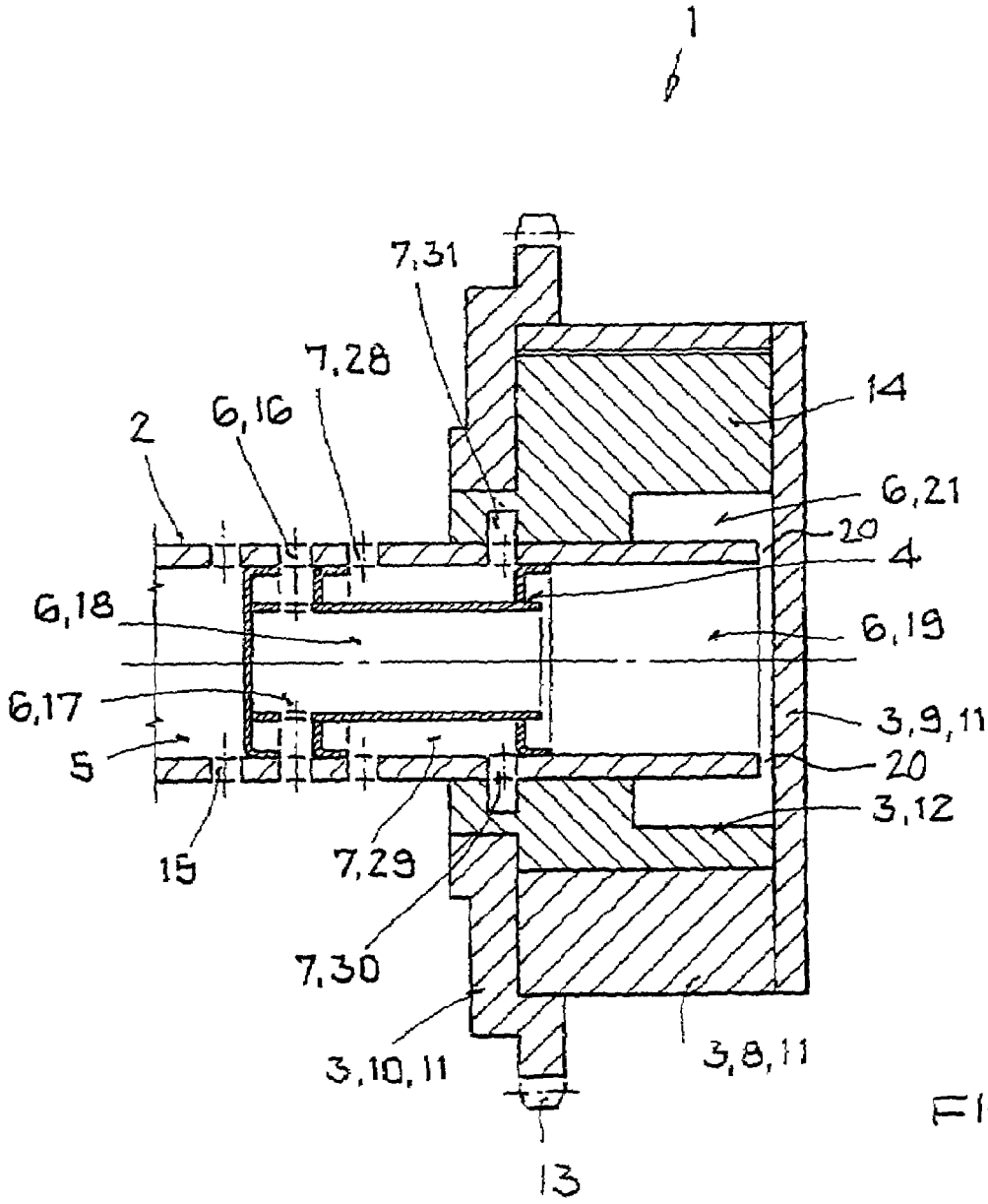
FIG. 2 is a longitudinal cross-section through a second embodiment of a camshaft adjuster.

Setting unit 3 has a sleeve-shaped outer body 8 that surrounds camshaft 2. This body has wings that project inward and are not visible here. A disk shaped lid 9 is disposed on the side of outer body or housing 8 that faces the end of camshaft 2. This lid closes off the hollow camshaft 2 as shown in FIGS. 1 and 2, and has a central recess for camshaft 2 as shown in FIGS. 3 to 9. There is a drive wheel disposed on the side of housing or body 8 that faces an internal combustion engine. This drive wheel 10 is mounted to rotate on the camshaft 2, wherein wheel 10 has gear teeth 13 on its outside circumference, by way of which camshaft adjuster 1 is driven by the crankshaft, (not shown), of the internal combustion engine indicated. Instead of a chain drive that is indicated and mentioned here, other drive connections can also be used, such as notched belt drives or gearwheel drives. Drive wheel 10 has an inside diameter that is sufficiently large so that it can be guided over the cams of camshaft 2 during installation.

Lid 9, outer body 8, and drive wheel 10 form a torque transfer element 11 that is mounted to rotate on camshaft 2, and enclose a ring space in which an inner body 12, configured as a vane wheel, is arranged. Inner body 12 is attached on camshaft 2 so as to rotate with it. The attachment can take place by means of a substantive, non-positive and/or positive lock, such as, for example, by means of thermal joining, joining with an excess dimension, gluing, welding, pressing, pressing onto the knurled camshaft, or by means of other joining methods. Outer body 8, is mounted to rotate on camshaft 2, and is assigned to or coupled to inner body 12.

Camshaft adjuster 1 possess a torque transfer element 11 affixed to rotate on camshaft 2. There is also at least one vane 14, formed by inner body 12, which is connected to rotate with camshaft 2. There is also at least one pressure chamber, not visible, which is formed between camshaft 2 and torque transfer element 11, and which is divided into the two working chambers A and B by means of vane 14.

To transfer the drive moment of the crankshaft to camshaft 2, inner body 12 of camshaft adjuster 1 is connected with camshaft 2 so as to rotate with it. The drive moment is introduced into camshaft adjuster 1 via outer body 10 and is transferred to inner body 12 by way of the working chambers A and B. The phase position between the outer body 10 of camshaft adjuster 1 and camshaft 2 can be adjusted by means of varying the hydraulic medium fill level of working chambers A and B. The control valve controls the hydraulic medium supply to the camshaft adjuster 1 and thereby the phase position, or for example, its change.

Figure 3:
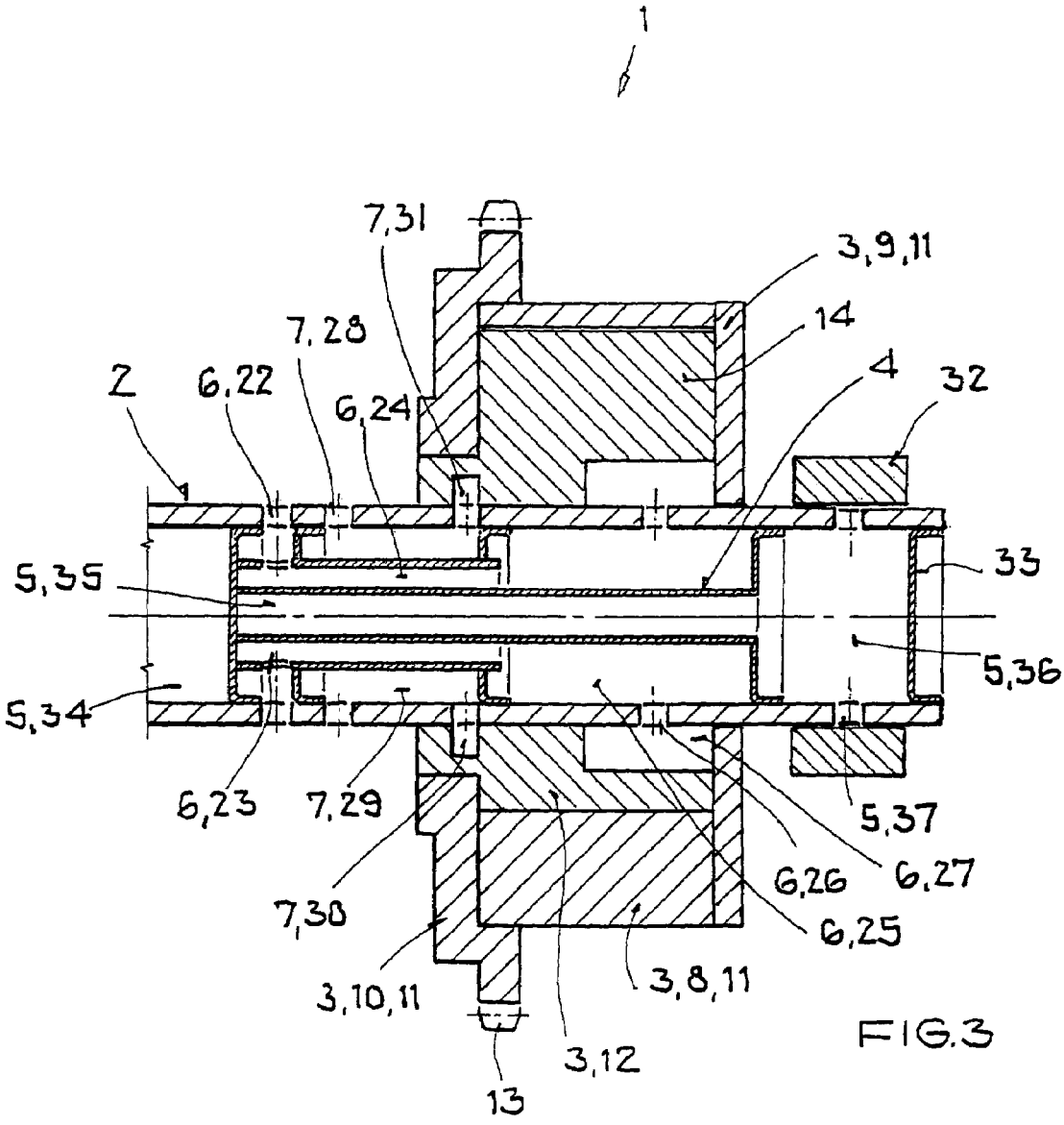
FIG. 3 is a longitudinal cross-section through a third embodiment of a camshaft adjuster.
Figure 4:
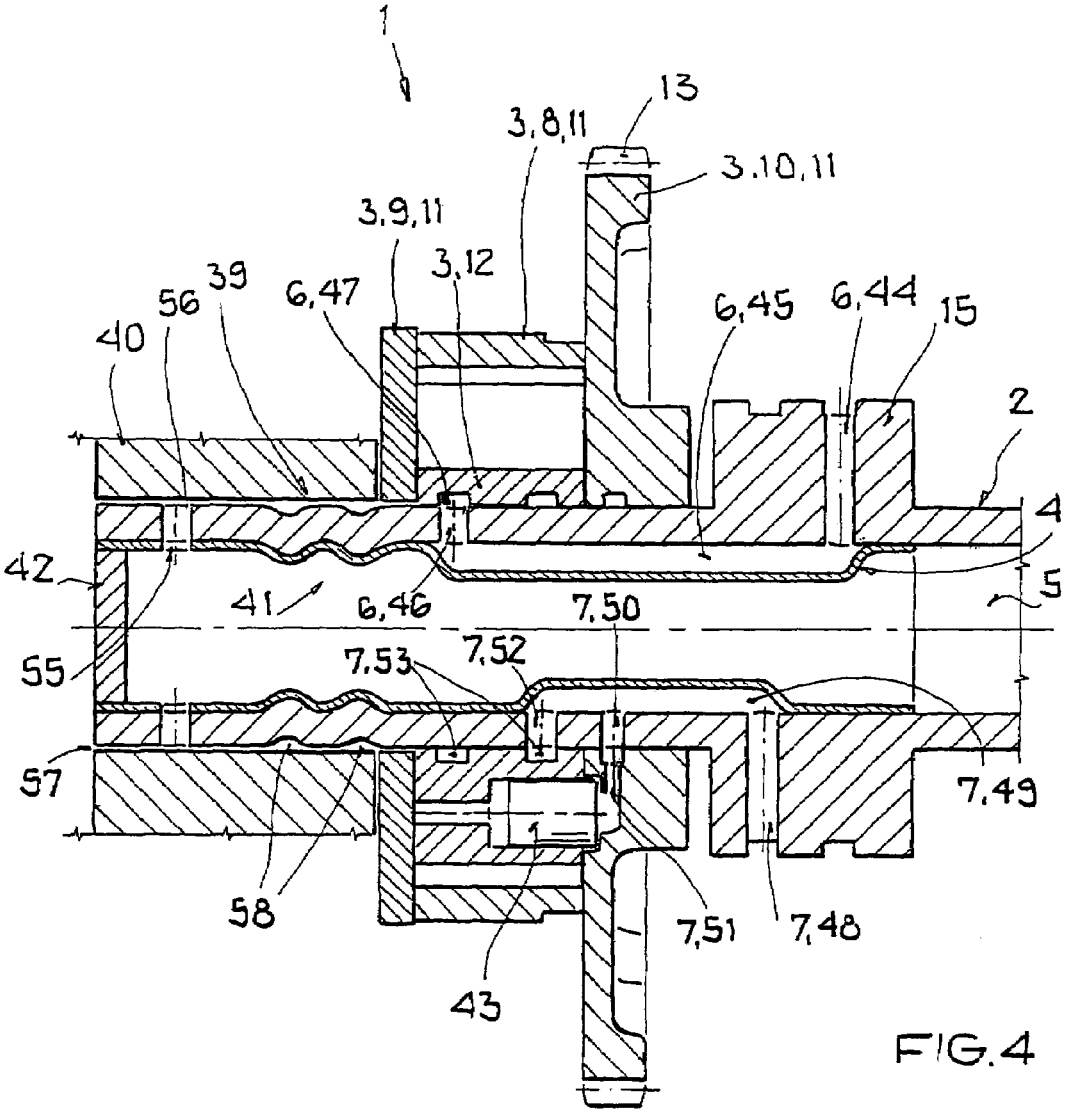
FIG. 4 is a longitudinal cross-section through a fourth embodiment of a camshaft adjuster.

FIGS. 1, 3, and 4, show that control valve 38 is supplied with hydraulic medium from a pressure medium line, not shown here, of the internal combustion engine. In this case, according to FIGS. 2, and 5–9, the hydraulic medium supply 15 of control valve 38 comes from hydraulic medium guide 5 in camshaft 2.

The supply of hydraulic medium to working chambers A or B, in each instance, takes place from control valve 38 by way of the hydraulic medium guides 6 and 7 formed by camshaft 2 and insert part 4. For example, hydraulic medium guide 6 supplies working chamber A, and hydraulic medium guide 7 supplies working chamber B with hydraulic medium.

FIGS. 1 and 2, show a radial bore 16 is used so that a hydraulic medium that is used for impacting working chamber A, flows into a first pressure space 17 of hydraulic medium guide 6 arranged in camshaft 2. From first pressure space 17, the hydraulic medium is guided into a second pressure space 19 via a tube-shaped region 18 within hydraulic medium guide 7. Proceeding from this pressure space 19, the hydraulic medium reaches a ring space 21 arranged in inner body 12, by way of a gap 20 between camshaft 2 and lid 9. From ring space 21, the hydraulic medium is guided into working chamber A by way of bores and grooves in inner body 12, in a known manner. According to FIG. 3, the hydraulic medium for impacting working chamber A also gets into a first ring space 23 of hydraulic medium guide 6 arranged in camshaft 2, via a radial bore 22, whereby ring space 23 surrounds hydraulic medium guide 5. From this ring space 23, the hydraulic medium is guided into a third ring space 25 that furthermore surrounds hydraulic medium guide 5, via a second ring space 24 that furthermore surrounds hydraulic medium guide 5 and is surrounded, on the outside, by the hydraulic medium guide 7. Proceeding from this ring space 25, the hydraulic medium reaches a ring space 27 arranged in the inner body 12, via a radial bore 26. From ring space 27, the hydraulic medium is guided into working chamber A by way of bores and grooves in inner body 12, in a known manner.

According to FIGS. 1 to 3, the hydraulic medium for impacting the working chamber B reaches a first ring space 29 of the hydraulic medium guide 7 arranged in camshaft 2, via radial bore 28 made in camshaft 2. With this design, ring space 29 surrounds tube-shaped region 18 of hydraulic medium guide 6. Proceeding from this ring space 29, the hydraulic medium reaches a second ring space 31, arranged in inner body 12, via a radial bore 30 in camshaft 2, from where the hydraulic medium is passed into working chamber B via bores and grooves, in a known manner.

In a further embodiment of the invention shown in FIG. 3, camshaft 2 projects out of camshaft adjuster 1 on the side opposite outer body 10. This projection of camshaft 2 is so that it lies in an additional bearing point 32 according to FIG. 3, or to accommodate an impulse wheel, not shown here, which mirrors or images the angle position of camshaft 2. With this design, camshaft 2 is closed off with a closure lid 33. The additional camshaft bearing 32 can also be supplied with hydraulic medium via a hydraulic medium guide 5 formed by insert part 4 and camshaft 2, wherein insert part 4 is lengthened accordingly. FIG. 3, shows that the hydraulic medium gets into a tube-shaped region 35 that is arranged within the hydraulic medium guide 6, via a pressure space 34 arranged in camshaft 2, whereby part of the hydraulic medium guide 6 is still surrounded by hydraulic medium guide 7. From the tube-shaped region 35, the hydraulic medium is guided into a second pressure space 36, which supplies the camshaft bearing 32 with hydraulic medium by way of a radial feed guide 37, whereby pressure space 36 is delimited by closure lid 33 on the side opposite outer body 10. With the extension of camshaft 2, it is also possible to join an impulse wheel onto camshaft 2, ahead of camshaft adjuster 1.

FIG. 4 shows a fourth embodiment of camshaft adjuster 1 with an insert part 4. Insert part 4 is inserted, with a positive lock, into the hollow camshaft 2, which has a wave-shaped region 39 at its end, wherein this region is arranged in the region of an additional camshaft bearing 40. Since insert part 4 is inserted into camshaft 2 with a positive lock, it therefore also forms a corresponding wave-shaped region 41. The open end of hollow camshaft 2, which faces lid 9, (See FIG. 1) is closed off with a closure lid 42 that is arranged within insert part 4. Camshaft adjuster 1 has a locking mechanism formed from a bolt 43 and a pressure spring, not shown here, which can be activated hydraulically, and provides a rigid connection between inner body 12 and drive wheel 10 via an axial movement of bolt 43. This connection can be released by applying hydraulic medium to camshaft adjuster 1, in a targeted manner, and an adjustment is released.

To supply hydraulic medium to the camshaft adjuster, as shown in FIG. 4 the hydraulic medium in hydraulic medium circuit 6 reaches a pressure space 45 arranged between insert part 4 and camshaft 2, by way of a radial bore 44 arranged in the region of a bearing 15, in order to impact the working chamber A. The hydraulic medium proceeds from this pressure space 45 by way of a radial bore 46 arranged in the camshaft 2 into a ring space 47 arranged in the inner body 12. From the ring space 47, the hydraulic medium is guided into the working chamber A by way of bores and grooves in inner body 12, in a known manner.

To impact working chamber B, the hydraulic medium in the hydraulic medium circuit 7 reaches pressure space 49 that is arranged between insert part 4 and camshaft 2, by way of a radial bore 48 that is made in camshaft 2. Proceeding from this pressure space 49, the hydraulic medium reaches locking mechanism 43. Locking mechanism 43 can be activated hydraulically, by way of a radial bore 50 in camshaft 2 and radial bores 51 in drive wheel 10, as well as ring spaces 53 arranged in inner body 12, by way of another radial bore 52 made in the camshaft 2, from where the hydraulic medium is guided into the working chamber B by way of bores and grooves, in a known manner. The additional camshaft bearing 40 is supplied with hydraulic medium via the hydraulic medium circuit 5 formed by insert part 4 and camshaft 2, wherein insert part 4 is configured to be appropriately long.

According to FIG. 4, the hydraulic medium moves from the interior of camshaft 2 into grooves 57, which open into ring spaces 58 formed because of the wave-shaped progression of camshaft 2 and the straight progression of bearing 40, wherein these grooves are arranged between camshaft 2 and bearing 40, via insert part 4 and radial bores 55, 56 made in camshaft 2.

Figure 5:
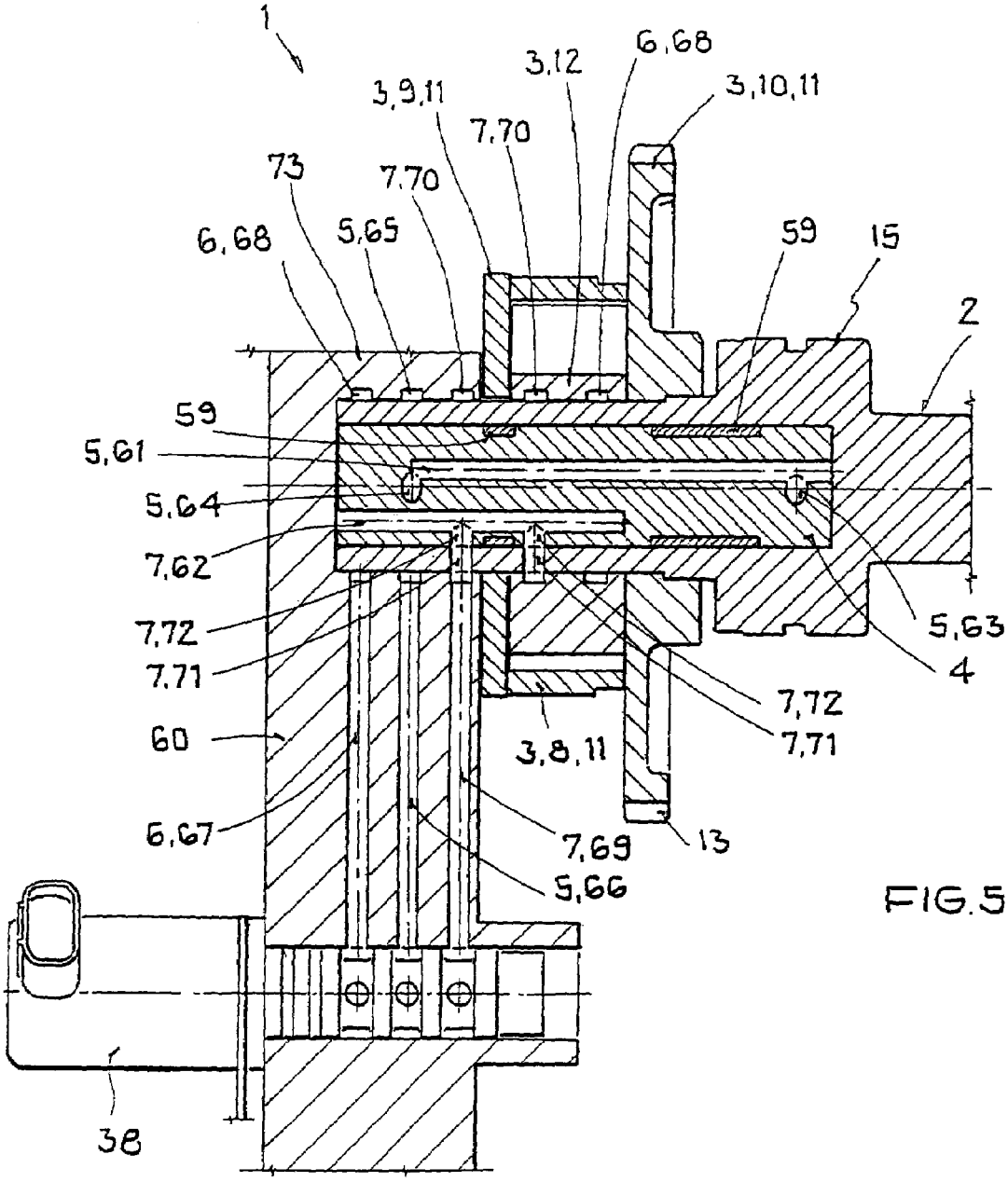
FIG. 5 is a longitudinal cross-section through a fifth embodiment of a camshaft adjuster

FIG. 5 shows a fifth embodiment of a camshaft adjuster 1 wherein insert part 4 is structured as a combination molded part, the body of which consists at least predominantly of plastic or aluminum. Insert part 4 contains hydraulic medium guides 5, 6 and 7, at least in part, or forms them together with camshaft 2. Furthermore, insert part 4 has support elements 59 such as support rings or support ring segments, for example, which stand in mechanical contact with the inside wall of camshaft 2 in the installed state of insert part 4. Camshaft adjuster 1 includes hydraulic control valve 38 that is arranged outside camshaft 2, in housing 60 of the internal combustion engine. Camshaft adjuster 1 has the three hydraulic medium circuits 5, 6, and 7, which can be controlled via control valve 38, whereby part of the hydraulic medium circuits 5, 6, and 7 are formed via non-coaxial channels 61, and 62 in insert part 4.

Control valve 38 is supplied with hydraulic medium via a first hydraulic medium circuit 5, which flows to and from camshaft 2 via channel 61, radial bores 63 and 64, a groove 65, and a bore 66. Working chamber A is impacted by control valve 38 via second hydraulic medium circuit 6 with a bore 67 and grooves 68, and third hydraulic medium circuit 7 having a bore 69, grooves 70, and radial bores 71, 72 which are needed to impact working chamber B. Furthermore, circuits 5, 6, and 7 also supply a camshaft bearing 73 with hydraulic medium for lubrication.

Figure 6:
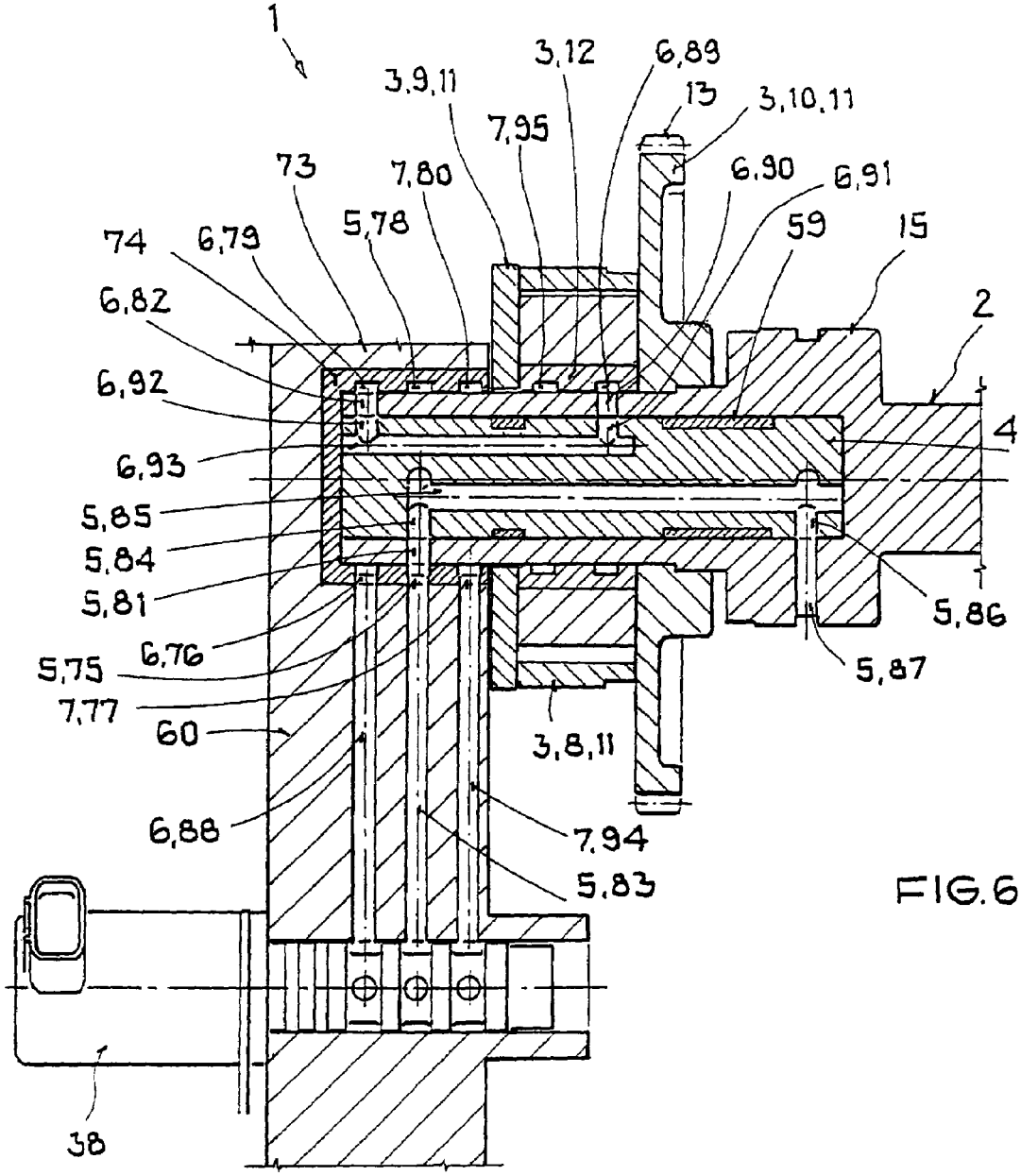
FIG. 6 is a longitudinal cross-section through a sixth embodiment of a camshaft adjuster including a transfer unit.

FIG. 6 shows a sixth example or embodiment of camshaft adjuster 1 in which another insert part 74, is configured as a transfer unit, which may be disposed outside of camshaft 2, and is provided in addition to the insert part 4 that is configured as a combination molded part. Transfer unit 74 is disposed in housing 60, in the region of camshaft bearing 73, and takes over the distribution function for the hydraulic medium. Transfer unit 74 has radial bores 75, 76, and 77 and grooves 78, 79 and 80, which stand in contact with hydraulic medium guides 81, and 82 of camshaft 2 in the installed state of transfer unit 74.

Control valve 38 is supplied with hydraulic medium by way of a first hydraulic medium circuit 5, to and from camshaft 2, by way of radial bores 87 and 86, a non-coaxial channel 85, a radial bore 84, the hydraulic medium guide 81, the groove 78, the radial bore 75, and a channel 83. Impact on working chamber A by control valve 38 takes place by way of second hydraulic medium circuit 6 having a bore 88, the radial bore 76, the grooves 79 and 89, the radial bores 82, 90 to 92, and a non-coaxial channel 93. In addition, the third hydraulic medium circuit 7 has a bore 94, radial bore 77, grooves 80 and 95 which is needed to impact working chamber B. Furthermore, circuits 5, 6 and 7 also supply camshaft bearing 73 with hydraulic medium for lubrication.

Figure 7:
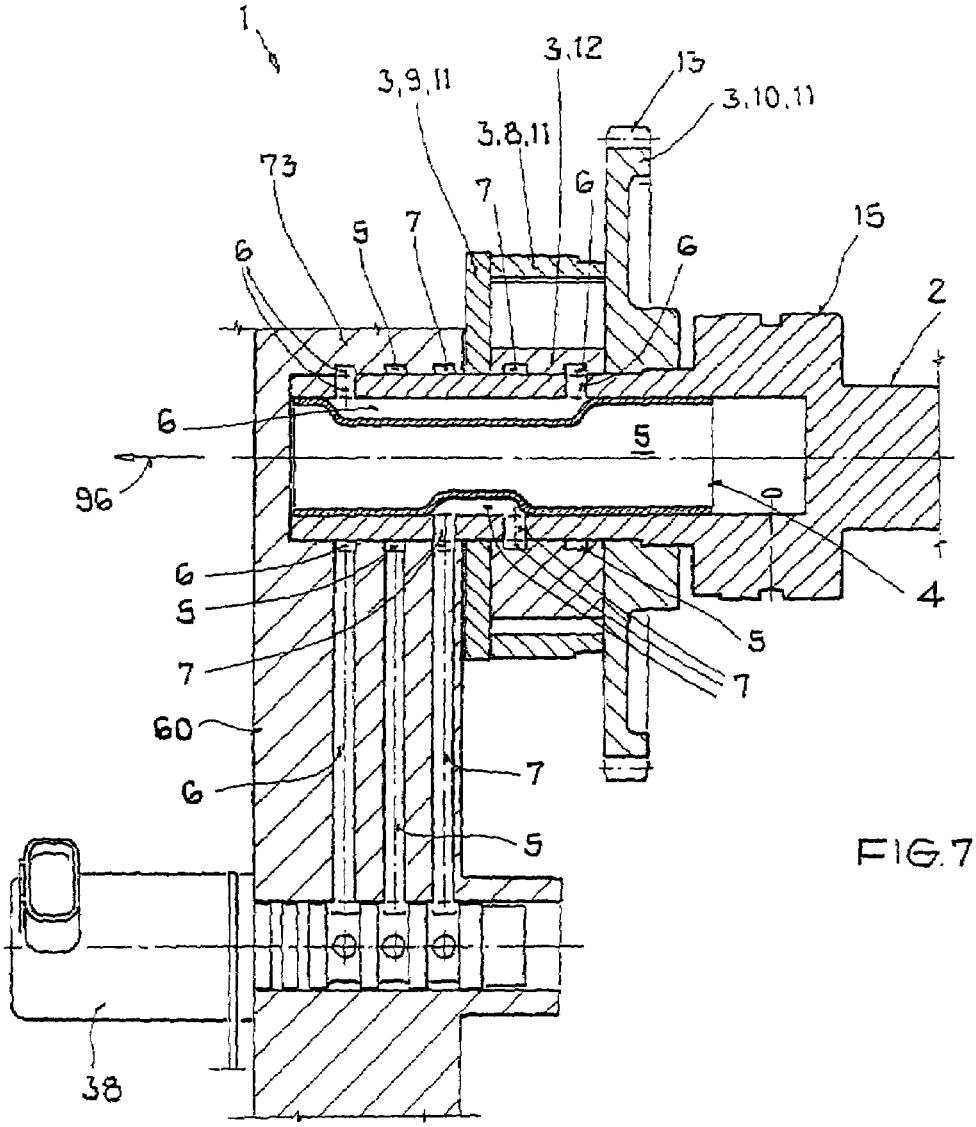
FIG. 7 is a longitudinal cross-section through a seventh embodiment of a camshaft adjuster, wherein the insert part has a changing cross-section.

FIG. 7 shows a seventh embodiment of a camshaft adjuster 1 with a one-piece insert part 4 that has cross-sections that change in the axial longitudinal direction 96, and with the hydraulic medium circuits 5, 6 and 7. Alternatively, it would be possible that insert part 4 has non-coaxial channels, for example according to FIG. 6, and/or contours with uniform and/or variable cross-sections over axial length 96, for example as shown in FIG. 7, or forms them together with camshaft 2.

FIG. 8 shows an eighth embodiment of camshaft adjuster 1 having a multi-part insert part 4 and hydraulic medium circuits 5, 6 and 7.

Figure 9:
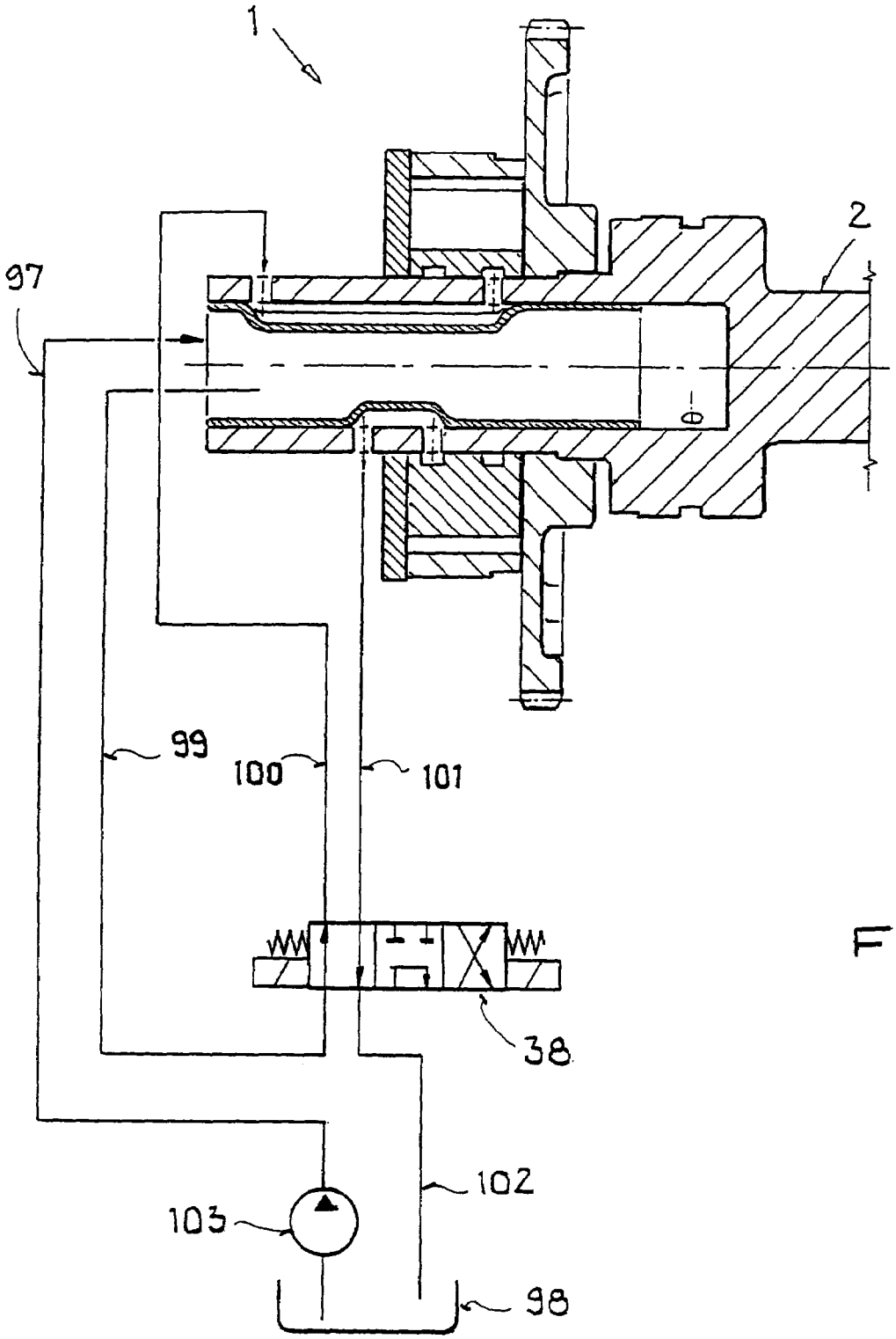
FIG. 9 is a longitudinal cross-section through a camshaft adjuster having a control valve and a hydraulic medium system.

FIG. 9 shows camshaft adjuster 1 according to FIG. 7 with control valve 38 and a circuit structure shown schematically, wherein a hydraulic medium guide 97, proceeds from an oil pan 98, by way of a pump 103 of an internal combustion engine, and applies hydraulic medium to camshaft 2, wherein a hydraulic medium guide 99, proceeding from camshaft 2, applies hydraulic medium to control valve 38, a hydraulic medium guide 100, proceeding from control valve 38, applies hydraulic medium to working chamber B, and a hydraulic medium circuit 101, also proceeding from control valve 38, applies hydraulic medium to working chamber A, whereby hydraulic medium drainage takes place via hydraulic medium guide 102, into the oil pan 98 of the internal combustion engine.

Figure 10:
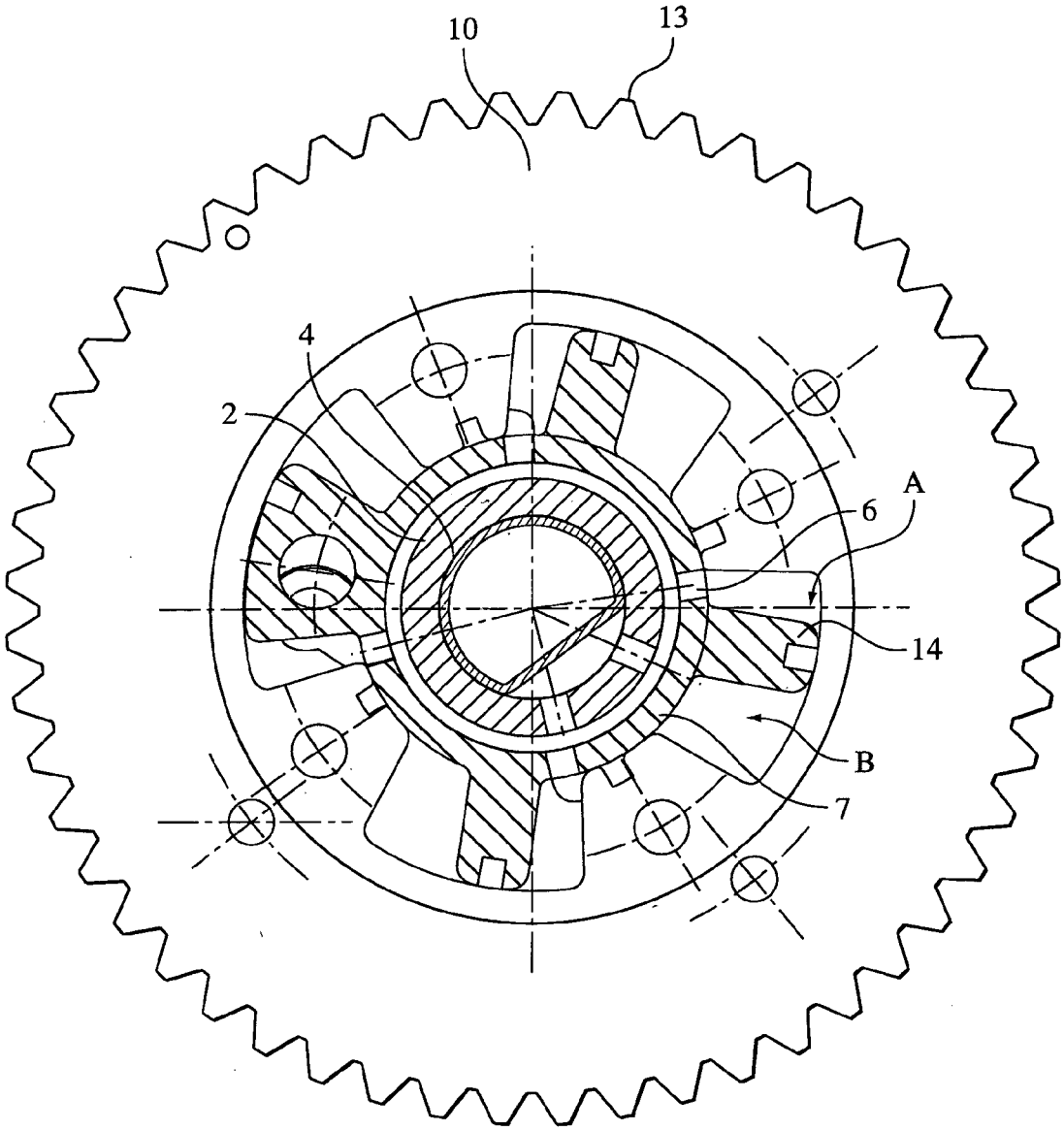
FIG. 10 is a latitudinal cross-sectional view of any one of the previous embodiments showing working chambers.

FIG. 10 shows an example of a latitudinal cross section of camshaft adjuster 1 which shows working chambers A and B wherein working chamber A is disposed on one side of vane 14 and working chamber B is disposed in the other side of vane 14. This example also shows insert part 4 disposed inside of camshaft 2, and drive wheel 10 having gear teeth 13 as well. As stated above, the phase position between the outer body 10 of camshaft adjuster 1 and camshaft 2 can be adjusted by means of varying the hydraulic medium fill level of working chambers A and B. Control valve 38 controls the hydraulic medium supply to the camshaft adjuster 1 and thereby the phase position, or for example, its change in position.

Accordingly, while a few embodiments of the present invention have been shown and described, it is to be understood that many changes and modifications may be made thereunto without departing from the spirit and scope of the invention as defined in the appended claims.

What is claimed is:

1. A camshaft adjuster for an internal combustion engine comprising:

a) a camshaft;

b) a setting unit comprising:

i) an inner body coupled to said camshaft so as to rotate with it; and ii) an outer body that is coupled to said inner body and mounted in an outer region relative to said inner body and said camshaft;

c) a control unit for adjusting an angle of said camshaft; and d) at least one insert part disposed inside an inner region of said camshaft, wherein said insert is formed from a sheet metal reinforced plastic component, wherein said insert part and said camshaft form a plurality of hydraulic medium guides, wherein at least one hydraulic medium guide is in communication with said control unit and wherein said setting unit is in communication with least one hydraulic medium guide so that said setting unit can be controlled by said control unit to set an angle of said camshaft and wherein said hydraulic medium guides are formed non-coaxially such that said hydraulic medium guides form a variable channel cross section across an axial length of said camshaft.

2. The camshaft adjuster as in claim 1, wherein said at least one hydraulic medium guide is directly connected to said control unit.

3. The camshaft adjuster as in claim 1, further comprising a transfer unit wherein said at least one hydraulic medium guide is coupled to said control unit via said transfer unit.

4. The camshaft adjuster as in claim 1, further comprising a channel disposed outside of said camshaft, wherein said channel is in communication with said at least one hydraulic medium guide.

5. The camshaft adjuster as in claim 1, wherein said insert part is joined to said camshaft by at least one of the following methods: thermal joining, gluing, welding, soldering, internal high pressure forming, shrinking, or pressing with excess dimension.

6. The camshaft adjuster as in claim 1, wherein said inner body is inserted onto said camshaft to form a substantive positive lock between said inner body and said camshaft.

7. The camshaft adjuster as in claim 1, wherein said control unit controls said hydraulic medium guides and wherein said control unit is positioned outside of said camshaft.

8. The camshaft adjuster as in claim 1, wherein said insert piece provides a hydraulic medium guide from said camshaft to said control unit.

9. The camshaft adjuster as in claim 3, wherein said insert piece and said transfer unit provide at least one hydraulic medium guide from said camshaft to said control unit.

10. The camshaft adjuster as in claim 1, further comprising at least one additional hydraulic medium guide for providing hydraulic medium to said control unit, wherein said at least one additional hydraulic medium guide charges the camshaft adjuster with control oil via said at least one hydraulic medium guide.

11. The camshaft adjuster as in claim 1, wherein said control unit is a hydraulic control valve.

12. The camshaft adjuster as in claim 1, wherein said at least one hydraulic medium guide is in the form of a hydraulic medium circuit.

13. The camshaft adjuster as in claim 1, further comprising a locking device and a camshaft bearing wherein said at least one hydraulic medium guide serves to supply the camshaft adjuster, said looking device and said hydraulic medium guide.

14. A camshaft adjuster as in claim 1, further comprising an impulse wheel, which is coupled to said camshaft.

15. The camshaft adjuster as in claim 1, wherein said insert part is formed from at least one part.

16. The camshaft adjuster as in claim 1, wherein said insert part is formed from a plurality of parts.

17. The camshaft adjuster as in claim 1, wherein the camshaft adjuster can be applied with hydraulic medium in a radial manner from said camshaft.

18. The camshaft adjuster as in claim 1, wherein said insert part is formed from sheet metal formed parts.

19. The camshaft adjuster as in claim 1, wherein said insert part is formed from pipes.

20. The camshaft adjuster as in claim 1, wherein said insert part has at least one non-coaxial channel having a cross-section that is uniform over its axial length.

21. The camshaft adjuster as in claim 20, wherein said insert part forms at least one non-coaxial channel together with said camshaft.

22. The camshaft adjuster as in claim 1, wherein said insert part is formed from at least two sheet-metal parts which are permanently connected to each other via a connection method taken from the group consisting of: welding, soldering, gluing, crimping, riveting, pressing, shrinking, in place and pass through joining.

23. The camshaft adjuster as in claim 1, wherein said insert part has at least one radial bore and said camshaft has at least one corresponding radial bore wherein said at least one insert part radial bore is larger in diameter than said corresponding at least one camshaft radial bore.

24. The camshaft adjuster as in claim 1, wherein the camshaft adjuster can be applied with hydraulic medium in an axial manner from said camshaft.

25. The camshaft adjuster as in claim 1, wherein said insert part has at least one non-coaxial contour, having a cross-section that is uniform over its axial length.

26. The camshaft adjuster as in claim 1, wherein said insert part has at least one non-coaxial contour having a cross-section that is variable over its axial length.

27. The camshaft adjuster as in claim 25, wherein said insert part forms said at least one non-coaxial contour together with said camshaft.

28. The camshaft adjuster as in claim 26, wherein said insert part forms said at least one non-coaxial contour together with said camshaft.

29. The camshaft adjuster as in claim 1, wherein said inner body is inserted onto said camshaft to form a substantive non-positive lock between said inner body and said camshaft.

30. A camshaft adjuster for an internal combustion engine comprising:

a) a camshaft;

b) a setting unit comprising:

i) an inner body coupled to said camshaft so as to rotate with it wherein said inner body is inserted onto said camshaft to form a substantive positive lock between said inner body and said camshaft; and ii) an outer body that is coupled to said inner body and mounted in an outer region relative to said inner body and said camshaft;

c) a control unit for adjusting an angle of said camshaft; and d) at least one insert part disposed inside an inner region of said camshaft wherein said insert part and said camshaft form at least one hydraulic medium guide, wherein said at least one hydraulic medium guide is in communication with said control unit and wherein said setting unit is in communication with said at least one hydraulic medium guide so that said setting unit can be controlled by said control unit to set an angle of said camshaft.

* * * * *